US007237862B2

(12) United States Patent
McCamy

(10) Patent No.: US 7,237,862 B2
(45) Date of Patent: Jul. 3, 2007

(54) METHOD AND APPARATUS FOR PRODUCING FOUR COLORS BY SOLID APPLICATION OF ONLY TWO COLORING MEDIA

(76) Inventor: Calvin S. McCamy, 44 All Angels Hill Rd., Wappingers Falls, NY (US) 12590

( * ) Notice: Subject to any disclaimer, the term of this patent is extended or adjusted under 35 U.S.C. 154(b) by 181 days.

(21) Appl. No.: 10/969,940

(22) Filed: Oct. 22, 2004

(65) Prior Publication Data

US 2006/0087705 A1 Apr. 27, 2006

(51) Int. Cl.
*B41J 29/38* (2006.01)

(52) U.S. Cl. ..... 347/16

(58) Field of Classification Search ..... 347/40–43, 347/16; 358/502

See application file for complete search history.

(56) References Cited

U.S. PATENT DOCUMENTS 5,772,250 A 6/1998 Gasper
5,864,742 A 1/1999 Gasper et al.
6,103,353 A 8/2000 Gasper et al.
6,206,504 B1 3/2001 Payne
6,486,902 B1 11/2002 Spano
6,502,923 B2 1/2003 Payne
6,523,937 B1 2/2003 Payne
2002/0097289 A1 7/2002 Payne
2002/0101487 A1 * 8/2002 Petersen et al. ..... 347/85
2002/0175989 A1 11/2002 Spano
2003/0227510 A1 12/2003 Payne

OTHER PUBLICATIONS

McCamy, C.S., "Colors of Some Small Figures on Colored Grounds", Color Research and Application, vol. 28, No. 4, Aug. 2003, pp. 242-250.

* cited by examiner

*Primary Examiner*—Stephen Meier
*Assistant Examiner*—Jason Uhlenhake

(57) ABSTRACT

Processes for producing specified solid colored patterns and devices for the production of such patterns can be used to evoke the appearance of a color other than the colors that would be produced by simple solid application of the colorants used. Thus, for example, a printing process used for package printing, can print a four-color package using a two-color press and inks of only two colors, without the use of a halftone process.

13 Claims, 1 Drawing Sheet

METHOD AND APPARATUS FOR PRODUCING FOUR COLORS BY SOLID APPLICATION OF ONLY TWO COLORING MEDIA

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates generally to a process and apparatus for producing colored images and patterns by solid application of only two coloring media to elicit the appearance of four colors. Application of this patent may be illustrated by a printing process.

The most common method of printing is the use of a single-color press and a white substrate. The printed sheet exhibits two colors, white and the color of the ink used. The half-tone process permits printing all shades of color between white and the color of a solid printing of the ink. A common example of half-tone printing is a so-called "black and white" picture in a newspaper.

Full-color printing, by overprinting yellow, magenta, cyan, and black half-tone images on a white substrate, can exhibit any color within a broad gamut. Some printing devices in common use employ six inks to obtain a larger gamut than could be achieved with four colored inks.

BRIEF SUMMARY OF THE INVENTION

In the simplest embodiment of the process of the invention, the half-tone process would not be necessary, though it could be used. Conventional color-printing theory predicts that a press applying two inks at full strength, without overlays, can elicit the perception of three colors, the color of the substrate and the colors of the two inks. In applying the printing process of the invention, nothing would be done differently. The significant difference lies in designing the art or pattern to utilize a previously unknown visual effect discovered by the present inventor. The visual effect is produced as follows: on a yellow background, black and white dots or lines of a specific form appear vivid blue and; on a blue background, black and white dots or lines of a different specific form appear vivid yellow. Therefore, with a white substrate and solid printings of two inks, yellow and black, one can evoke the appearance of four colors: white, yellow, black, and blue. Similarly, with a white substrate and solid printings of two inks, blue and black, one can evoke the appearance of four colors, white, blue, black, and yellow. Alternatively, a yellow or blue substrate could be used with opaque black and white inks.

This process would be particularly advantageous in the package-printing industry, where cost is an important consideration and full-color images may no be needed. The invention permits a reduction in the cost of the press and the cost of inks. The only practical limitation is that the printed pattern must be designed to produce the desired visual effect. Within that limitation, an infinite variety of patterns is possible.

In an exemplary embodiment of the invention, a color printing process is provided for a color-printing device. The device includes a path along which a substrate is passed, a printing mechanism disposed adjacent the path, a controller controlling a position of the substrate and the printing mechanism, and an ink source coupled with the printing mechanism. The color printing process includes the steps of providing the ink source with only two colored inks, and applying the two colored inks to the substrate in a predetermined pattern to thereby evoke an appearance of four colors.

In one arrangement, the substrate is white, and the two colored inks are yellow and black. In this context, the applying step includes applying the two colored inks to thereby evoke the appearance of white, yellow, black and blue. In an alternative arrangement, the substrate is white, and the two colored inks are blue and black. In this context, the applying step includes applying the two colored inks to thereby evoke the appearance of white, blue, black, and yellow. In still another arrangement, the substrate is yellow, and the two colored inks are black and white. In this context, the applying step includes applying the two colored inks to thereby evoke the appearance of white, yellow, black and blue. In yet another arrangement, the substrate is blue, and the two colored inks are black and white. In this context, the applying step includes applying the two colored inks to thereby evoke the appearance of white, blue, black and yellow.

A black dot with a smaller white dot at or near the center of the black dot is a called a "tip." In this context, the applying step includes applying a tip on a blue substrate such that the white dot appears yellow. A white dot with a smaller black dot at or near the center of the white dot is called a "pit", and in this context, the applying step includes applying a pit on a yellow substrate such that the black dot appears blue. The applying step may include applying a white line within a black line (called a "tip line) on a blue substrate such that the white line appears yellow. Alternatively, the applying step may include applying a black line within a white line (called a "pit line") on a yellow substrate such that the black line appears blue.

In another exemplary embodiment of the invention, a color-printing device includes a path along which a substrate is passed. A printing mechanism is disposed adjacent the path, and a controller controls the position of the substrate and the printing mechanism. An ink source is coupled with the printing mechanism and includes only two colored inks, where the two colored inks are applied to the substrate by the printing mechanism via the controller in a predetermined pattern evoking the appearance of four colors.

In yet another exemplary embodiment of the invention, a color printing process includes the steps of providing an ink source with only two colored inks, and applying the two colored inks to a substrate in a predetermined pattern to thereby evoke the appearance of four colors.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
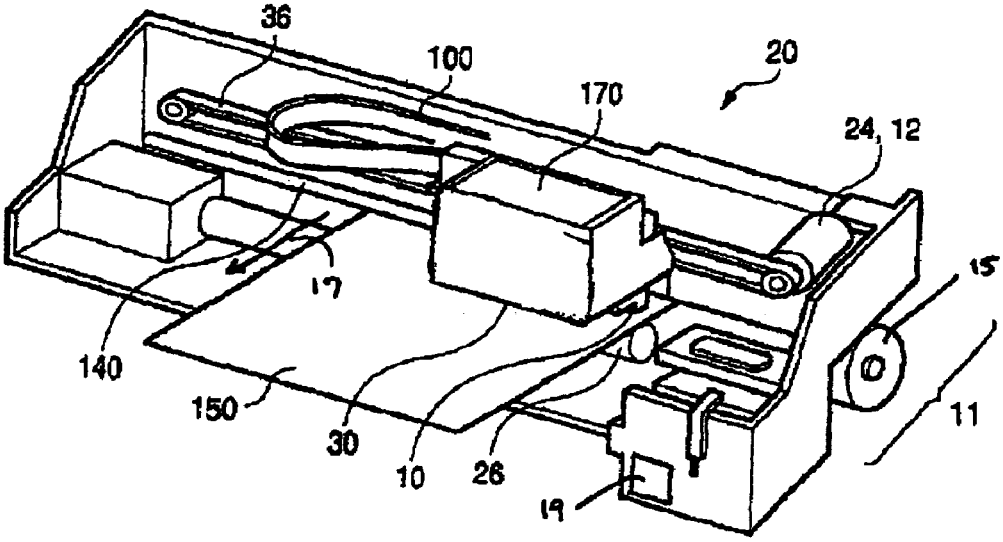
FIG. 1 illustrates a printing apparatus.

The present invention is applicable to any process producing a colored pattern as specified according to the invention to induce colors as described. For purposes of illustration, an example of an ink jet printer assembly suitable for the application of the present invention is shown in FIG. 1. The inkjet printer 20 includes a carriage 30 connected via a timing belt 36 to a carriage motor 24 of a carriage mechanism 12. The carriage 30 is guided by a guide member 140 for reciprocating movement along a width direction of a substrate 150, such as paper. A substrate feeding mechanism 11 includes a feeding roller 15 for feeding the substrate 150 along a path illustrated by arrow 17. A printing mechanism such as an ink jet printing head 10 is disposed adjacent the substrate path 17 and receives ink supply from an ink cartridge 170 mounted on the carriage 30. A controller 19 controls the printing head 10 and the carriage motor 24 such that the printing head 10 jets ink droplets of respective colors onto the printing paper 150 in conjunction with the transport of the carriage 30 to print images on the substrate 150.

The present invention utilizes a visual color phenomenon discovered by the inventor. The luminance distribution produced by a black dot with a smaller white dot at or near its center, called a "tip," or a black line with a narrower white line at or near its center, called a "tip line," appears vivid yellow against a blue background. A white dot with a small black dot at or near its center, called a "pit," or a white line with a narrower black line at or near its center, called a "pit line," appears vivid blue against a yellow background. Details of the novel visual phenomenon are described, without reference to any practical application, in a published scientific paper authored by the inventor, C. S. McCamy, Colors of Some Small Figures on Colored Grounds, *Color Res. Appl.,* 28, 242–250 (2003), the contents of which are hereby incorporated by reference.

With the application of the discovered visual effect, a packaging printer can print a four-color package using a two-color press and only two inks. For example, the printer could print a blue background on white stock and use black ink with the white stock to print yellow lines and dots. Alternatively, the printer could print a yellow background and use black ink to print blue lines or dots.

Figure 2:
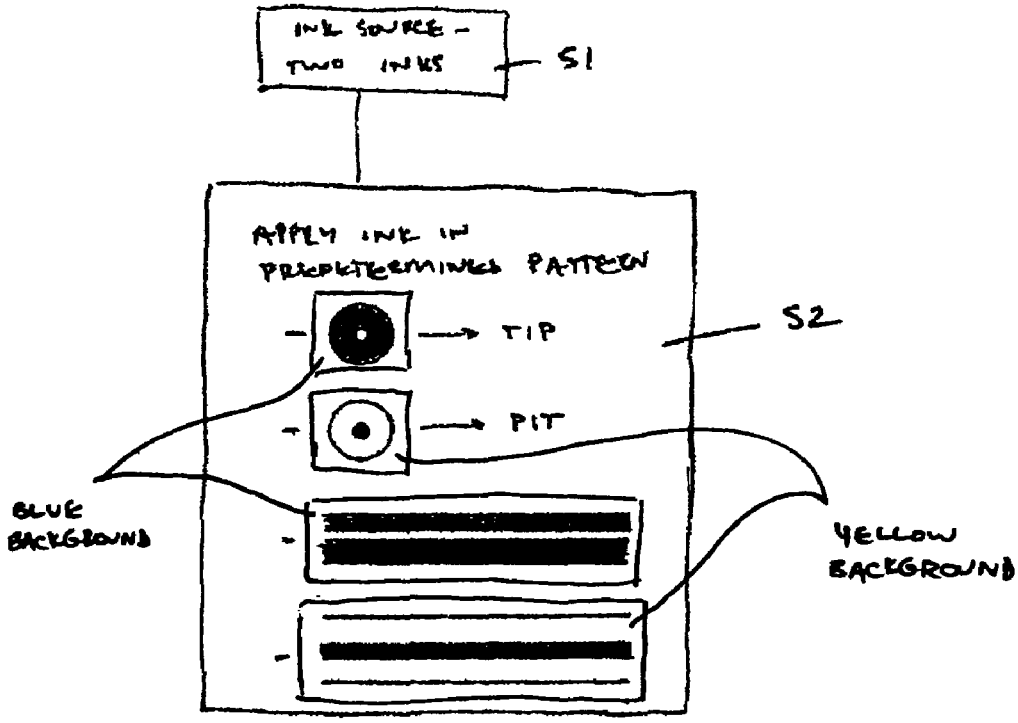
FIG. 2 is a flowchart of the printing process according to the present invention, illustrating the forms of the dot and line patterns used.

FIG. 2 is a flowchart of the process according to the present invention. Initially, the ink source is provided with only two colored inks (step S1). The two colored inks can then be applied to the substrate in a predetermined pattern to thereby evoke an appearance of four colors (step S2). FIG. 2 also illustrates exemplary predetermined patterns to evoke the effect, including a tip, a tip line, a pit, and a pit line. Using the visual effect and printing in predetermined patterns, yellow lines and dots can be printed using only blue and black inks, while blue lines and dots can be printed using only yellow and black inks.

With the present invention, cost savings via use of fewer ink colors can be advantageously achieved. Space savings may also be achieved using only two ink colors. The mere novelty of the image process would likely have commercial appeal. The process is of course applicable to brochure printing and other trade pieces, etc.

In the description of this invention, there are references to backgrounds of the colors yellow and blue. The kind of visual effect described here may be observed with background colors ranging widely in hue, even red and green, the color appearance produced depending on the hue of the background. However, the strongest affects are obtained with a background that is a yellow color with a hue such that it appears neither orangish nor greenish or a background that is a blue color with a hue such that it appears neither greenish nor purplish. The strongest effect is produced by background colors that are vivid, i.e., of high saturation. Though the specifications of this invention are described in terms of vivid yellow and blue backgrounds, backgrounds of other colors used with the patterns specified to produce the kinds of effects described are included in this invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims. Such modifications include media such as painting, silk screening, stenciling, or the production of textiles or other materials with colored patterns.

The invention claimed is:

1. A color printing process for a color printing device including a path along which a substrate is passed, a printing mechanism disposed adjacent the path, a controller controlling a position of the substrate and the printing mechanism, and an ink source coupled with the printing mechanism, the color printing process comprising:

providing the ink source with only two colored inks; and applying the two colored inks to the substrate in a predetermined pattern to thereby evoke an appearance of four colors, wherein the substrate is white, and the inks are yellow and black, the applying step comprising applying the two colored inks to thereby evoke the appearance of white, yellow, black and blue.

2. A color printing process for a color printing device including a path along which a substrate is passed, a printing mechanism disposed adjacent the path, a controller controlling a position of the substrate and the printing mechanism, and an ink source coupled with the printing mechanism, the color printing process comprising:

providing the ink source with only two colored inks; and applying the two colored inks to the substrate in a predetermined pattern to thereby evoke an appearance of four colors, wherein the substrate is white, and the inks are blue and black, the applying step comprising applying the two colored inks to thereby evoke the appearance of white, blue, black, and yellow.

3. A color printing device comprising:

a path along which a substrate is passed;

a printing mechanism disposed adjacent the path;

a controller controlling the position of the substrate and the printing mechanism; and an ink source coupled with the printing mechanism, the ink source including only two colored inks, wherein the inks are applied to the substrate by the printing mechanism via the controller in a predetermined pattern evoking an appearance of four colors.

4. A color printing device according to claim 3, wherein the two colored inks are applied as a tip on a blue substrate such that the white dot appears yellow.

5. A color printing device according to claim 3, wherein the two colored inks are applied as a pit on a yellow substrate such that the white dot appears blue.

6. A color printing device according to claim 3, wherein the two colored inks are applied as a white line within a black line on a blue substrate such that the white line appears yellow.

7. A color printing device according to claim 3, wherein the two colored inks are applied as a black line within a white line on a yellow substrate such that the black line appears blue.

8. A color printing device according to claim 3, wherein the substrate is white, and the inks are yellow and black, the two inks being applied in the predetermined pattern to evoke the appearance of white, yellow, black and blue.

9. A color printing device according to claim 3, wherein the substrate is white, and the inks are blue and black, the inks being applied in the predetermined pattern to evoke the appearance of white, blue, black, and yellow.

10. A color printing device according to claim 3, wherein the substrate is yellow, and the inks are opaque black and white, the two colored inks being applied in the predetermined pattern to evoke the appearance of white, yellow, black and blue.

11. A color printing device according to claim 3, wherein the substrate is blue, and the inks are opaque black and white, the two colored inks being applied in the predetermined pattern to evoke the appearance of white, blue, black and yellow.

12. A color printing device according to claim 3, wherein the predetermined pattern comprises at least one of a tip or pit.

13. A color printing device according to claim 3, wherein the predetermined pattern comprises at least one of a tip line on a blue background such that the white line appears yellow or a pit line on a yellow substrate such that the black line appears blue.

* * * * *